US005561868A

United States Patent [19]

Campbell

[11] Patent Number: 5,561,868

[45] Date of Patent: Oct. 8, 1996

[54] MULTIPLE POSITION BATHTUB SEAT APPARATUS

[76] Inventor: Robert L. Campbell, 4540 Lords Ave., Sarasota, Fla. 34231

[21] Appl. No.: 384,841

[22] Filed: Feb. 7, 1995

[51] Int. Cl.[6] ..... A47K 3/02

[52] U.S. Cl. ..... 4/560.1

[58] Field of Search ..... 4/559, 560.1, 578.1, 4/579

[56] References Cited

U.S. PATENT DOCUMENTS

| | | | |
|---|---|---|---|
| 2,237,076 | 4/1941 | Kenney et al. | 4/579 |
| 2,648,849 | 8/1953 | Webb et al. | 4/560.1 |
| 4,150,445 | 4/1979 | Bailey | 4/560.1 |

FOREIGN PATENT DOCUMENTS

| | | | |
|---|---|---|---|
| 1586660 | 3/1981 | United Kingdom | 4/578.1 |

*Primary Examiner*—Charles E. Phillips
*Attorney, Agent, or Firm*—William E. Noonan

[57] ABSTRACT

A multiple position bathtub seat apparatus is disclosed for use in combination with the bathtub having a pair of generally parallel longitudinal sides. The apparatus includes a support frame that extends generally between the longitudinal sides. A seat portion is carried by the support frame. Rotatable bearings are attached to the support frame and an elongate track is supported above and extends along at least one of the longitudinal sides. At least some of the rotatable bearings engage the track for guiding the support frame and the seat to move selectively back and forth along the tub between multiple longitudinal positions.

19 Claims, 4 Drawing Sheets

MULTIPLE POSITION BATHTUB SEAT APPARATUS

FIELD OF THE INVENTION

This invention relates to a multiple position bathtub seat apparatus and, more particularly, to a seat that is mounted to move longitudinally back and forth along a bathtub so that a disabled person can conveniently shower in the tub.

BACKGROUND OF THE INVENTION

It is very often difficult, if not impossible, for a person with a physical handicap to use a standard bathtub shower, Stroke victims, prosthetic leg users or other persons who have difficulty standing or walking tend to experience considerable problems maneuvering in the tub and operating the wall-mounted shower controls. Entering and leaving the tub and standing in position under the shower can also be quite annoying and inconvenient for these individuals. In many cases, a caretaker is required to assist the disabled person.

A number of bathtub seats have been developed to facilitate the use of bathtub showers by handicapped persons. However, most of these appliances are designed to be fixed in position within the tub. Known seats cannot be readily manipulated in the tub so that the user can conveniently operate the bathtub and shower controls from the seat. Instead, the user is typically limited to a single position within the tub. Shifting the position of the seat during showering is annoying, awkward and time consuming. Moreover, many of the known bathtub seats do not provide the disabled person with quick and convenient assess into and out of the tub. Accordingly, a nurse, family member or other caretaker is still usually needed to reposition the seat, operate the shower controls and otherwise help the user.

At least one known device, McCartney, U.S. Pat. No. 4,941,218, features a bathtub seat that may be adjusted to various positions along the length of a bathtub. However, that seat cannot be moved quickly and conveniently while the individual who is showering remains seated. Rather, the seat must be disengaged from a track and lifted from the tub each time the position of the seat is changed. The user first must get up from the seat in order to reposition the apparatus. Again, the assistance of another individual is usually required.

SUMMARY OF INVENTION

It is therefore an object of the present invention to provide an improved bathtub seat that may be quickly and conveniently moved and repositioned along the length of a bathtub without having to disengage the seat from the tub.

It is a further object of this invention to provide a multiple position bathtub seat that make bathtubs, bathtub showers and shower controls much more accessible to disabled persons.

It is a further object of this invention to provide a multiple position bathtub seat apparatus that may be operated conveniently by a disabled individual with little or no assistance, while the individual remains seated.

It is a further object of this invention to provide a multiple position bathtub seat apparatus that locks securely and safely in a selected position along the tub.

It is a further object of this invention to provide a multiple position bathtub seat apparatus that may be installed in virtually all types of bathtubs for use in connection with virtually all types of bathtub showers.

This invention features a multiple position bathtub seat apparatus for use in combination with a bathtub having a pair of generally parallel longitudinal sides. There is a support frame that extends generally between the longitudinal sides of the bathtub. Means defining a seat portion are carried by the support frame between the longitudinal sides. Means are provided for movably mounting the support frame to the longitudinal sides of the tub. Such means include rotatable bearing means that are carried by the support frame and elongate track means that are supported above and extend along at least one of the longitudinal sides. The track means are engaged by at least a portion of the rotatable bearing means for guiding the support frame and the seat to move selectively back and forth along the tub between multiple longitudinal positions.

In a preferred embodiment, the track means include an inside track element arranged along an inner longitudinal side of the tub and the rotatable bearing means include inside wheel means that rotatably engage the inside track element. The rotatable bearing means may further include outside wheel means disposed above an outer longitudinal side of the bathtub. The outside wheel means may directly engage the outer longitudinal side. Alternatively, the track means may include an outside track element arranged along the outer longitudinal side and the outside wheel means may rotatably engage the outside track element.

Means may be provided for locking the support frame and the seat in a selected one of the longitudinal positions. The inside track means may include a plurality of slots that define selected longitudinal positions along the bathtub. A latching device may be connected to the support frame. The latching device is engageable with a selected one of the slots in the inside track element to lock the support frame in the selected position defined by the slot. The latching device may include a pin adjustably attached to the support assembly, spring means that bias the pin toward the inside track element into a selected one of the slots, and a handle secured to the pin for selectively removing the pin from the selected slot so that the support frame may be longitudinally repositioned along the bathtub. Stop means may be attached to a least one of the support frame, the seat portion and the pin for limiting the degree to which the pin may be moved away from the inner track element.

The support frame may include a generally flat central section that carries the seat portion, a raised inner section that carries the inside wheel means and a raised outer section that carries the outside wheel means. The raised outer section may support a side seat portion above the outer longitudinal side of the bathtub. The seat portion may include a horizontal seat surface that is generally coplanar with the seat portion. The seat portion may include a generally horizontal seat surface that is secured to the support frame and a generally vertical seat back that is connected to the horizontal seat surface. Releasable seat belt means may be secured to the seat portion. The position of the seat portion may be adjusted on the support frame.

DETAILED DESCRIPTION OF PREFERRED EMBODIMENTS

Other objects, features and advantages will occur from the following description of preferred embodiments and the accompanying drawings, in which.

Figure 1:
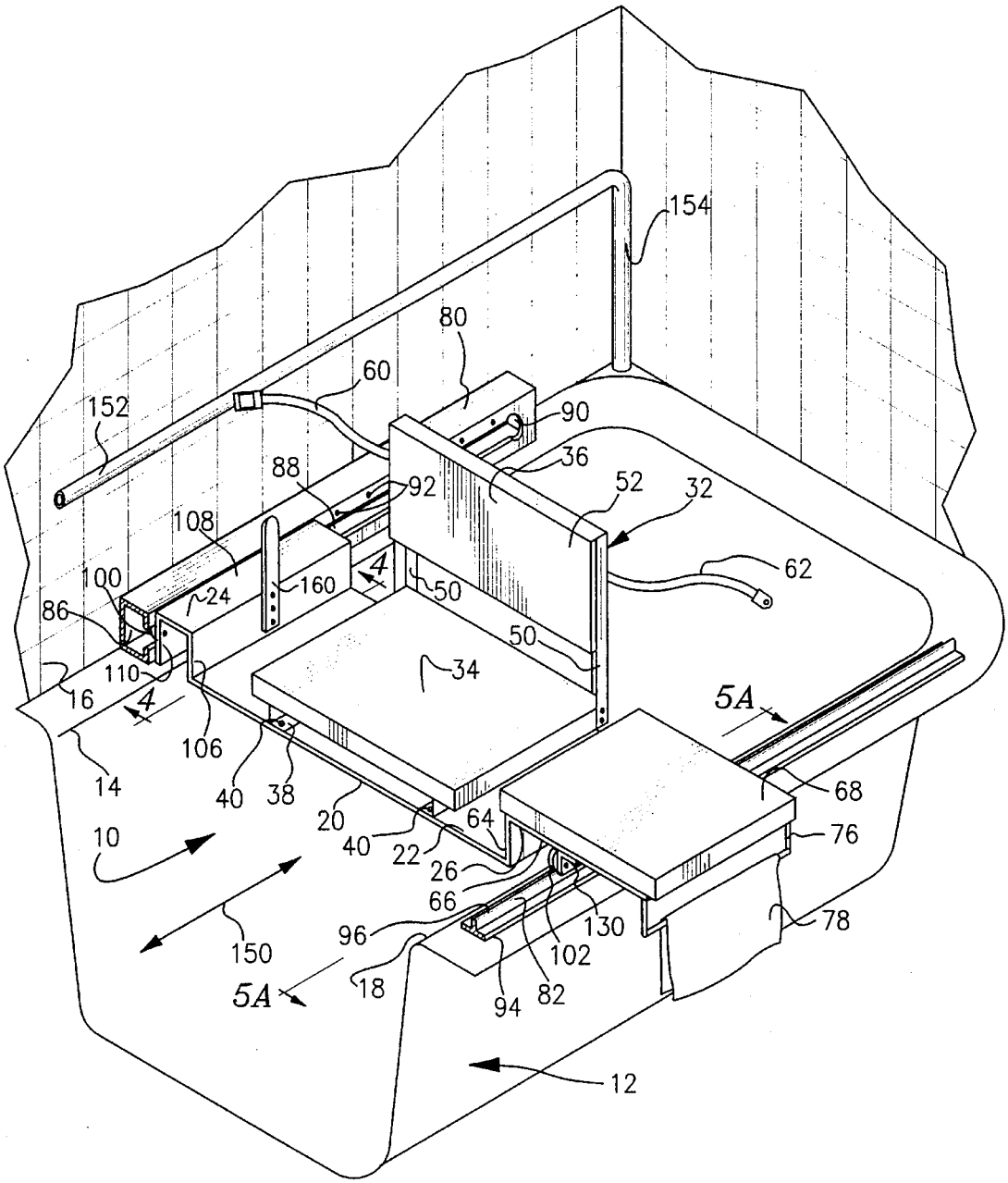
FIG. 1 is a perspective view of a preferred multiple position bathtub seat apparatus, according to this invention, mounted in a conventional bathtub.

There is shown in FIG. 1 a multiple position bathtub seat apparatus 10 that is mounted to roll back and forth along a conventional bathtub 12. The rearward end of bathtub 12 is depicted in FIG. 1. At the forward end of the tub, which is not shown, there are formed a conventional wall-mounted shower head that is pointed generally into the tub, as well as standard wall-mounted tub and shower controls. Tub 12 includes an inner longitudinal side 14 that extends beneath a tiled bathroom wall 16. The tub also includes an opposite, generally parallel outer longitudinal side 18. The details of the tub and shower construction are well known and do not comprise a part of this invention.

Figure 2:
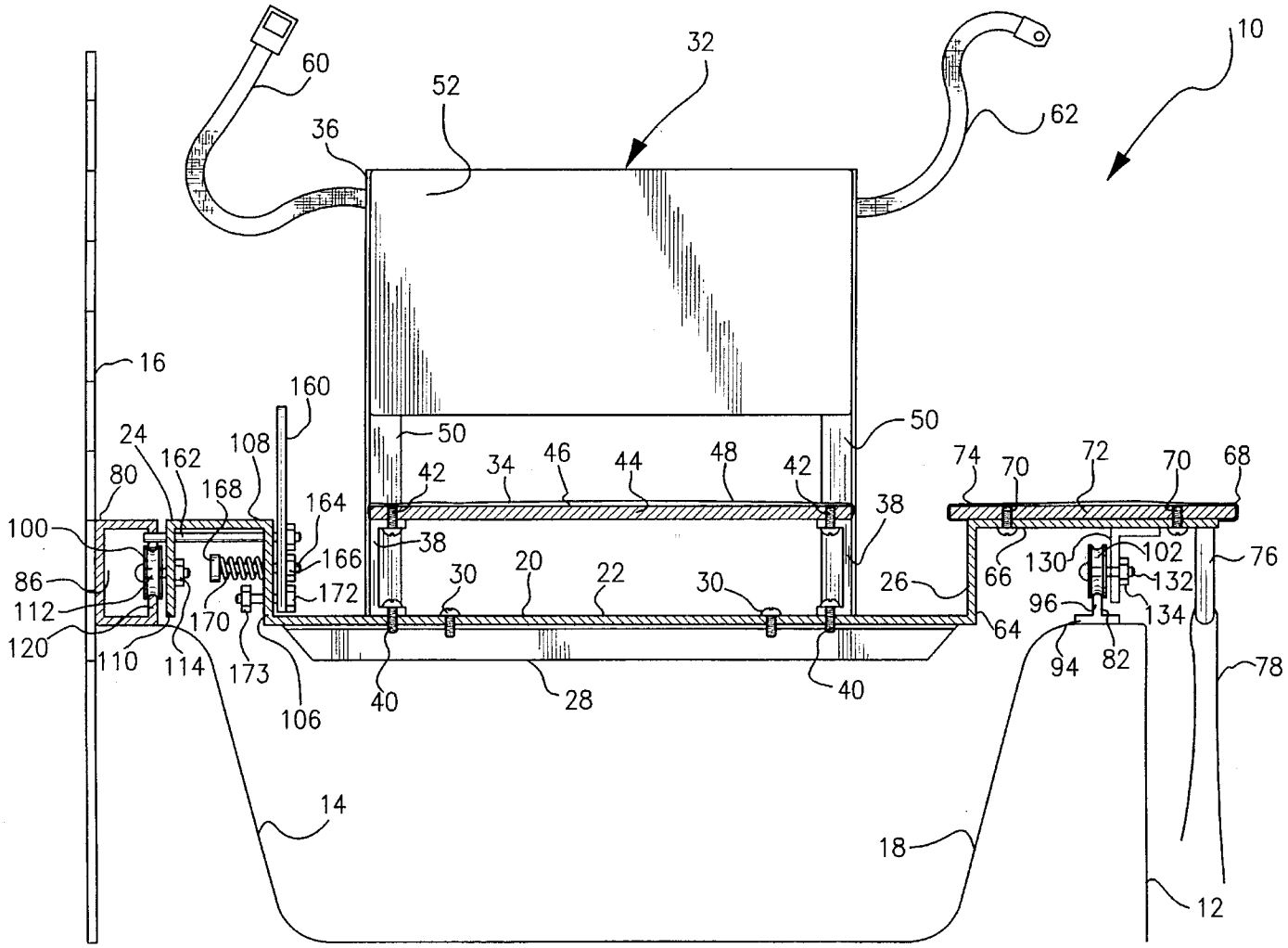
FIG. 2 is an elevational front view, partly in cross section, of the bathtub seat apparatus.

As illustrated in FIGS. 1 and 2, apparatus 10 includes a support frame 20 that extends transversely generally between bathtub sides 14 and 18. Support frame 20 is preferably composed of a unitary sheet of stainless steel or formed aluminum having, a thickness of not less than 3/16". The frame has a generally flat central section 22, a raised inside section 24 and a raised outside section 26. Sections 24 and 26 are unitarily connected to central section 22. Inside section 24 has a generally inverted U cross sectional shape. Raised section 26 defines an outside platform that extends generally above tub side 18. One or more tubular struts or braces 28 are secured to the bottom of central section 22 by bolts 30. Braces 28 provide improved strength and rigidity for the support frame so that it will adequately support a person seated thereon in the manner described more fully below.

Figure 3:
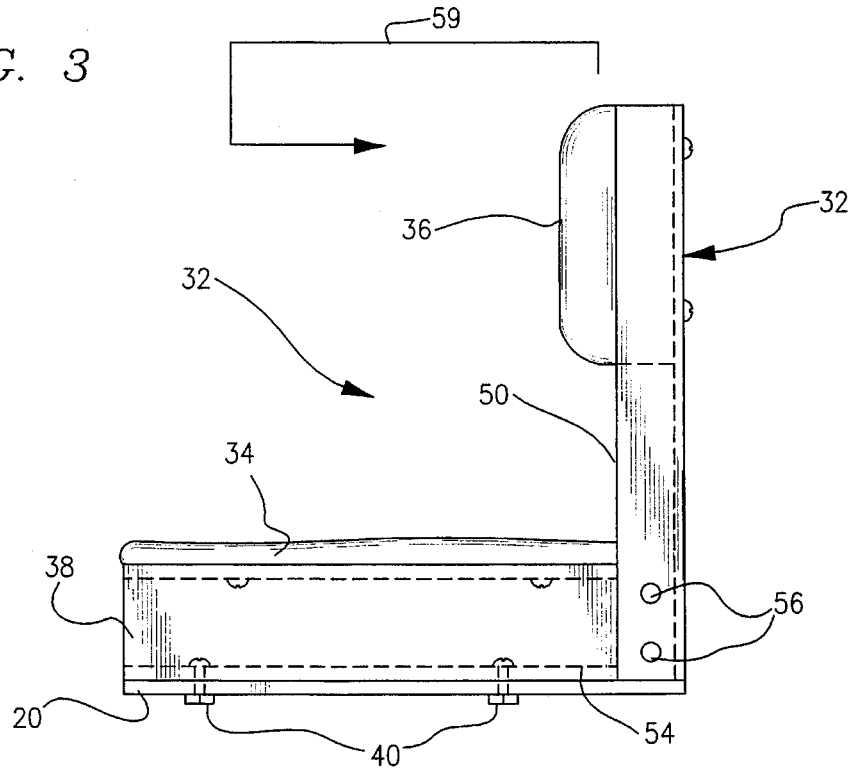
FIG. 3 is an elevational side view of a preferred seat portion.

A seat portion 32 is mounted on central section 22 of support frame 20. Seat portion 32, which is also illustrated in FIG. 3, includes a generally horizontal seat surface 34 and a seat back 36. Horizontal seat surface 34 is supported above frame 20 by a pair of U-shaped support elements 38 that extend generally longitudinally of bathtub 12 and transversely of frame 20. Channel elements 38 are spaced apart along central section 22 and are positioned on the frame such that their respective longitudinal channels face one another. Channel elements 38 are secured to frame 20 by appropriate bolts or other connectors 40. Horizontal seat surface 34 is similarly secured to the top surfaces of channel elements 38 by bolts 42, FIG. 2. The horizontal seat surface comprises a flat interior portion 44 that is composed of plywood or some other somewhat flexible but rugged synthetic or wood material. Polyurethane or foam padding 46 is attached to element 44 and a water resistant vinyl or plastic covering, 48 is wrapped over padding 46 and secured to element 44 by staples, adhesives, or other known means.

As illustrated in FIGS. 1–3, seat back 36 comprises a pair of generally spaced apart and parallel vertical support elements 50 that carry a generally vertical, padded seat back support member 52. Elements 50 are L-shaped elements composed of extruded aluminum or similar material. As best shown in FIG. 3, the inside surface of each member 50 engages an outside surface of a respective channel element 38 proximate the rearward end of the channel element and the lower end of the vertical support element. It should be noted that an analogous interengagement is exhibited between the other channel element and vertical support that are not shown in FIG. 3. A pair of mounting bolts 56 and associated obscured nuts engage aligned holes to interconnect each vertical support element with its respective channel element. Vertical seat back member 52 is secured by appropriate bolts 57 to each of the vertical support elements 50.

Seat 32 is assembled by attaching seat back 36 to horizontal seat surface 34. In particular, each element 50 of seat back 36 is engaged with a respective corresponding support channel element 38 by sliding one of the arms of element 50 outside the channel element such that the mounting holes in element 50 line up with the corresponding holes in channel element 38. As stated, appropriate bolts are secured through the aligned holes on each side of the seat to secure the seat back 36 to the channel elements 38. The seat 32 may be removed from the support frame and reversed, as indicated by arrow 59, so that the user may be seated to face rearwardly in the tub. This is accomplished by detaching the connectors 40 and removing seat 32 from frame 20. Seat 32 is then reversed. The complementary holes in the connector elements 38 and frame 20 are positioned such that corresponding respective holes can be aligned for either orientation of seat portion 32. Accordingly, in the reversed orientation connectors 40 are again used to engage the aligned holes and fasten the seat portion to the support frame. In this manner, the seat 32 may be assembled so that the user can face in either direction in tub 12.

As shown in FIGS. 1 and 2, complementary seat belt straps 60 and 62 may be secured to respective vertical support elements 50. Such attachment may be made by bolts, rivets or any other appropriate attachment means. The seat belt is secured to the user in a conventional manner to provide improved support and security for the user during the use of apparatus 10. This will become more apparent as the use of the apparatus is described below.

Raised outside segment 26 of frame 20 includes a generally vertical portion 64 and a generally horizontal platform portion 66. A horizontal side seat portion 68 is secured to platform 66 by bolts 70 or analogous attachment means. Side seat 68, like horizontal seat surface 34, includes an interior planar element 72 that is typically composed of plywood. A resilient material such as foam 74 covers planar element 72 and a vinyl or other waterproof material covers foam 74. As with seat surface 34, side seat 68 is assembled in a conventional manner. The side seat is supported such that it is substantially coplanar with horizontal seat surface 34. Side seat 68 is utilized in a manner that, again, will be described more fully below.

A towel bar 76, FIGS. 1 and 2, depends from platform 66 outside of tub 12 and is secured to platform 66 by screws, adhesive or other attachment means. Bar 76 holds a towel 78 in a location that is conveniently accessible to a user of apparatus 10.

Means are provided for movably mounting support frame 20 and seat portions 32 and 68 to bathtub 12 such that the support frame and attached seats are movable longitudinally back and forth along the tub. As best shown in FIGS. 1 and 2, elongate track means are supported above and extend along the respective sides 14 and 18 of tub 12. The track means include an elongate inside track element 80 that is supported above and extends along inner side 14 and an elongate outside track element 82 that is supported above and extends along outer side 18. Track elements 80 and 82 are arranged such that they are generally parallel to one another. The track elements extend for any desired length along the respective sides of the tub. In FIG. 1, elements 80 and 82 stop short of the rearward wall of tub 12. However, in alternative embodiments, each track element may extend fully from the front wall to the rear wall of the tub. Track element 80 comprises an elongate tube having a generally rectangular cross sectional shape. The tube is preferably composed of extruded aluminum having a thickness of approximately ⅛". Other dimensions and alternative rust resistant materials, such as nylon or an alternative relatively rigid plastic, may be employed within the scope of this invention. Track element 80 is placed directly on or slightly above the upper surface of inner tub side 14 and is fastened to bathroom wall 16 by appropriate screws or bolts or by an adhesive such as silicone or waterproof epoxy. Adhesive may also be applied between the bottom of track element 80 and the upper surface of tub side 14. The particular fastening means used for track element 80 is not critical. However, such means may not be strong enough to support a person seated on apparatus 10. An alternative particular fastening means is disclosed more fully below in connection with FIGS. 6 and 7.

Track element 80 has an interior chamber 86. As best shown in FIG. 1, a longitudinal slot 88 is formed in the interiorly facing surface of the track. Slot 88 includes an enlarged recess 90 formed proximate one end thereof. A plurality of positioning holes 92 are formed along the inwardly facing surface of the track beneath slot 88.

Outside track element 82 comprises a generally flat base 94 that is secured to the upper surface of outer tub side 18 by silicone or some other waterproof adhesive. An elongate rail portion 96 extends upwardly and unitarily from base 94. Track element 82 is preferably composed of nylon or some other synthetic or metallic material that offers relatively low frictional resistance to a wheel bearing, such that movement of the apparatus is facilitated in the manner described more fully below. In alternative embodiments the outside track element may be eliminated.

Figure 4:
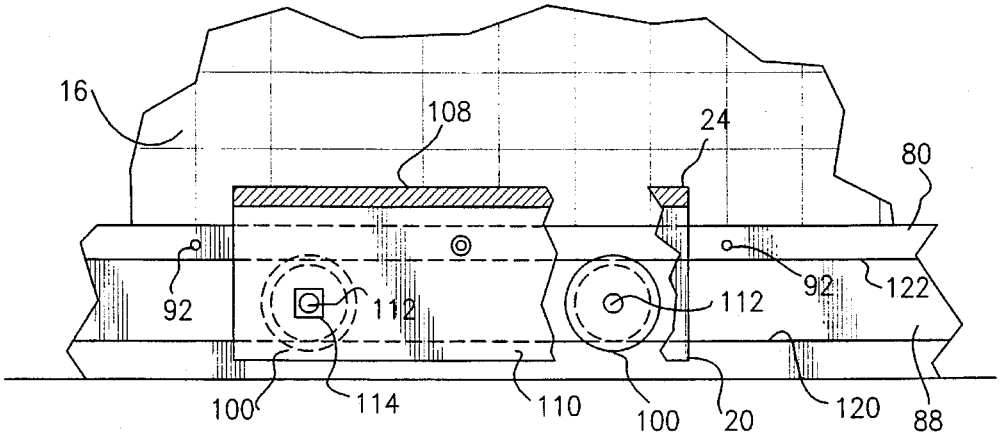
FIG. 4 is a cross sectional view taken along line 4—4 of FIG. 1.

Rotatable bearing means are provided for mounting support frame 20 to track elements 80 and 82. In particular, a first set of inside roller or wheel bearings 100, FIGS. 1, 2 and 4, are carried by raised segment 24 of frame 20 for interengaging track element 80. A second set of roller or wheel bearings 102, FIGS. 1, 2 and 5, are carried by platform 66 of raised segment 26 for interengaging track element 82. As best illustrated in FIGS. 4 and 5, respectively, apparatus 10 preferably employs a pair of inside wheel bearings 100 and a pair of outside wheel bearings 102. Referring to FIGS. 1, 2 and 4 raised frame section 24 includes a vertical segment 106, a horizontal segment 108 and a distal, depending segment 110. Each of bearings 100 is rotatably mounted to depending segment 110 by an appropriate threaded axle 112 that is connected to section 110 by a respective nut 114. As best shown in FIG. 2, each wheel bearing 100 includes a generally concave circumferential surface. The bearings 100 are received in elongate track slot 88 such that they roll along the lower edge 120 of slot 88. (See also FIG. 4.)There is a slight amount of clearance provided between the bearings and the upper edge 122 of the slot. This allows both bearings 100 to roll freely within the slot. At the same time, due to the concave circumferential surface of the wheel bearing, the outer edges of each bearing extend slightly above upper edge 122. As a result, both bearings 100 remain locked securely within slot 88 of track element 80 while rolling back and forth along the track. In this manner, bearings 100 support the inner end of frame 20 on track element 80.

Figure 5A:
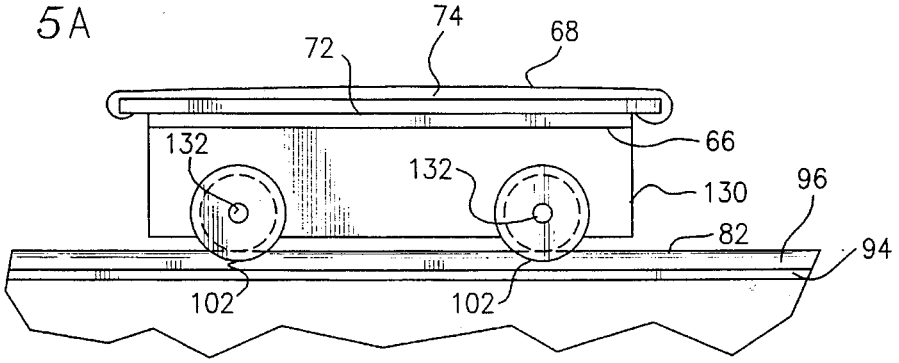
FIG. 5A is a cross sectional view taken along line 5A—5A of FIG. 1.
Figure 5B:
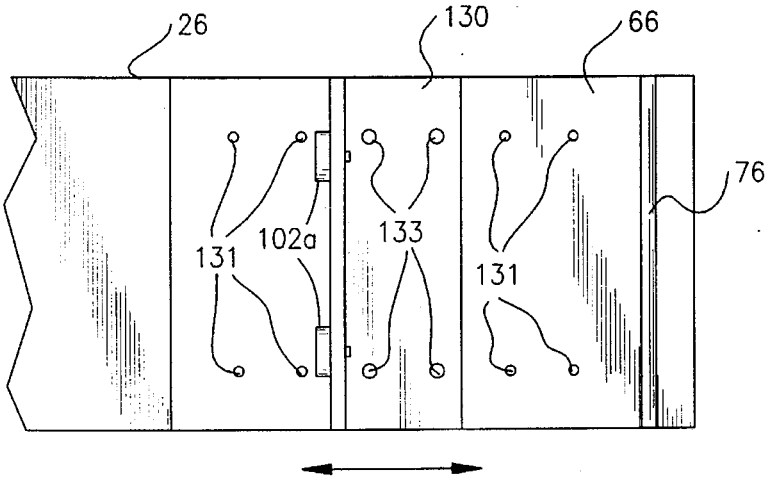
FIG. 5B is a bottom view of an alternative side seat portion and outside wheels.

As illustrated in FIGS. 1, 2 and 5A outside wheel bearings 102 are rotatably mounted to an aluminum L-shaped support bracket 130. The support bracket is itself secured to the bottom surface of platform 66 by suitable attachment means such as an adhesive, screws or bolts. Bearings 102 are carried by respective threaded shafts 132 that are themselves secured to bracket 130 by respective nuts 134, FIG. 2. Each wheel bearing 102 has a concave circumferential surface that conformably engages the convex upper surface of rail 82. Accordingly, wheel bearings 102 maintain positive engagement with track element 82 and resist lateral movement and derailing from the track. In this manner, the outside end of support frame 28 is movably mounted to the outer longitudinal side 18 of tub 12.

When no outside track element is used the outer wheel bearings directly engage the upper surface of tub side 18. In such an embodiment, illustrated in FIG. 5B, outer wheel bearings **102*a* have a transversely flat circumferential surface. Again, a pair of wheels are rotatably mounted to a bracket 130. The bracket includes a plurality of mounting holes that are aligned with selected corresponding holes 131 formed in the bottom of platform 66. Appropriate connector bolts 133 are releasably engaged with the aligned holes to secure bracket 130 to platform 66 at a desired position. By realigning the bracket holes with different groups of respective holes 131 and reattaching bolts 133, the lateral position of bracket 130 and wheels 102*a*** may be adjusted to accommodate alternative bathtub and outside tub wall widths.

Each of the wheel bearings 100 and 102 is preferably composed of nylon or some other relatively durable and water resistant plastic. The material should be selected so that relatively little friction and resistance to rolling is exhibited. Such construction enables apparatus 10 to move freely back and forth along tub 12.

As best shown in FIG. 1, wheel bearings 100 and 102 permit support frame 20 and seat portions 32 and 68 to roll back and forth longitudinally relative to tub 12, as indicated by double headed arrow 150. The user may remain seated on seat portion 32 and employ his or her feet to drive apparatus 10. Alternatively, the user may remain seated and move apparatus 10 along the tub by grasping a hand rail 152 that is mounted to wall 16 and extends along the length of tub 12. Hand rail 152 may be secured directly to wall 16 or, alternatively, may be supported by vertical posts 154 formed at each end of the tub. In any event, the user is able to position himself or herself at a desired point in the tub. Initially, the user may wish to roll apparatus 10 forwardly so that shower controls can be reached. Subsequently, the user can roll apparatus 10 rearwardly along the tub into a comfortable position beneath the shower head. The positive interengagement between the concave circumferential surfaces of bearings 100 and 102 and respective track elements restricts apparatus 10 from moving laterally relative to the tub.

A locking mechanism is provided so that apparatus 10 may be fixed at one of a number of selected longitudinal positions along tub 12. The locking mechanism includes a handle bar 160, FIGS. 1 and 2, that is secured to raised frame segment 24. An elongate pin 162 is connected perpendicularly to handle bar 160. Pin 162 extends through corresponding holes (not shown) in sections 106 and 110 of raised segment 24. The distal end of pin 162 is selectively received in one of the positioning holes 92 formed in track element 80. An elongate bolt 164 is secured to handle bar 160 below pin 162. Bolt 164 extends through an opening in section 106 of raised segment 24. A nut 166 is attached to a threaded end of bolt 164 inside of handle bar 160. The opposite end of bolt 164 includes a head 168. A compression spring 170 is formed between head 168 and frame section 106. When handle bar 160 is pulled inwardly toward seat portion 32, pin 162 is retracted from a respective hole 92 in track element 80. As a result, the locking mechanism is disengaged from track element 80 so that rollers 100 are permitted to roll in the track and frame 20 is permitted to move back and forth along the tub. Spring 170 biases bolt 164 and, accordingly, pin 162 outwardly toward track element 80. As a result, the user may fix support frame 20 at a desired longitudinal position along the tub by moving the frame until the position of pin 162 corresponds with a selected positioning hole 92 on track element 80. Handle bar 160 is then released. Spring 170 urges the handle bar and pin 162 outwardly such that the pin engages the corresponding hole and locks the support frame in position. A stop bolt 172, FIG. 2, is mounted to the pin 160 below bolt 166 and extends through a hole (not shown) in frame section 106. An adjustable nut 173 threadably attached to bolt 172 limits the degree to which handle bar 160 can be pulled inwardly toward the seat.

Apparatus 10 is operated in the following manner. Initially, the user sits on side seat 68 so that he or she can conveniently gain access to seat 32. The user next lifts his or her legs over outer tub side 18 (either with or without assistance) and maneuvers onto coplanar horizontal seat surface 34. Seat belt straps 60 and 62 are engaged. Typically, at this point, apparatus 10 is in a locked position with pin 162 received in a corresponding one of the positioning holes 92 in track element 80. The user therefore releases support frame 20 and seat 32 for longitudinal movement within the tub by retracting handle bar 160. The user is then pushed, or employs his or her legs or handrail 152, to drive support frame 20 forwardly along track elements 80 and 82. As a result, the user moves forwardly to the shower controls. After the shower is turned on, the user or his assistant pushes frame 20 and seat 32 rearwardly to a selected longitudinal position in the tub. Handle bar 160 is then released to introduce pin 162 into a corresponding positioning hole 92. The bathtub seat apparatus is accordingly locked securely in position so that the user is properly positioned beneath the shower head. Subsequently, the user can reverse the position of seat 32, as previously described, so that they may wash their back. After showering is completed, the user rolls frame 20 and seat 22 forwardly to turn the shower off and then rolls the apparatus rearwardly to again lock the support frame 20 at a desired position. The user then dismounts the seat apparatus by maneuvering to seat portion 68, lifting his or her legs over the side of the tub and departing the tub. A towel 78 is conveniently draped on bar 76 for use as needed. Depending upon the condition of the user, the entire operation can be performed with or without the assistance of another person.

For cleaning, adjustment and repair, the apparatus can be removed by rolling frame 20 to the rearward position along the tracks such that the rearward inside wheel bearing 100 is positioned in recess 90. (FIG. 1) The recess is sufficiently large to permit the wheel bearing to be removed from or replaced in slot 88. In this position, frame 20 is pivoted horizontally to remove the rearward bearing from the recess. The support frame is then rolled further toward the recess until the other inside wheel bearing can be removed therefrom. At that point, the support frame is entirely disengaged from track element 80 and the support frame and seat can be removed entirely from the tub. A recess may also be formed at the forward end of track element 80.

Figure 6:
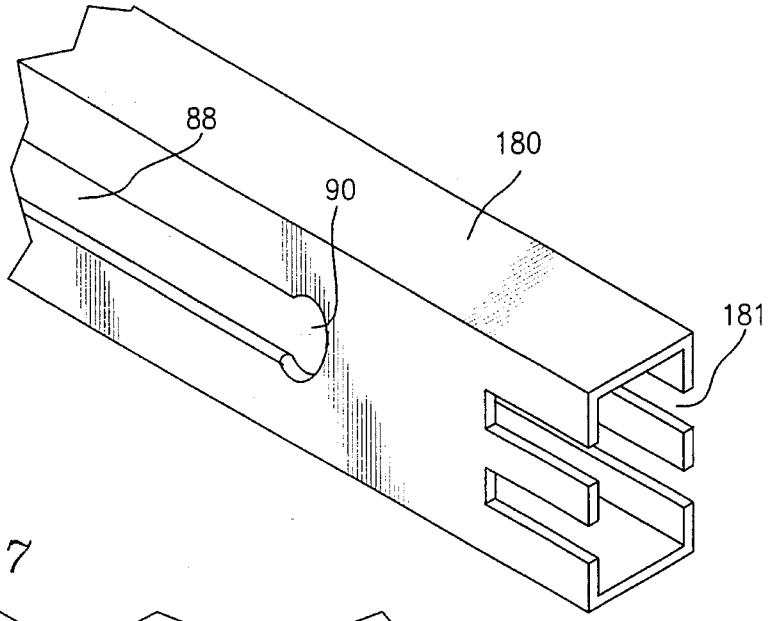
FIG. 6 is a partial perspective view of an alternative preferred track element.
Figure 7:
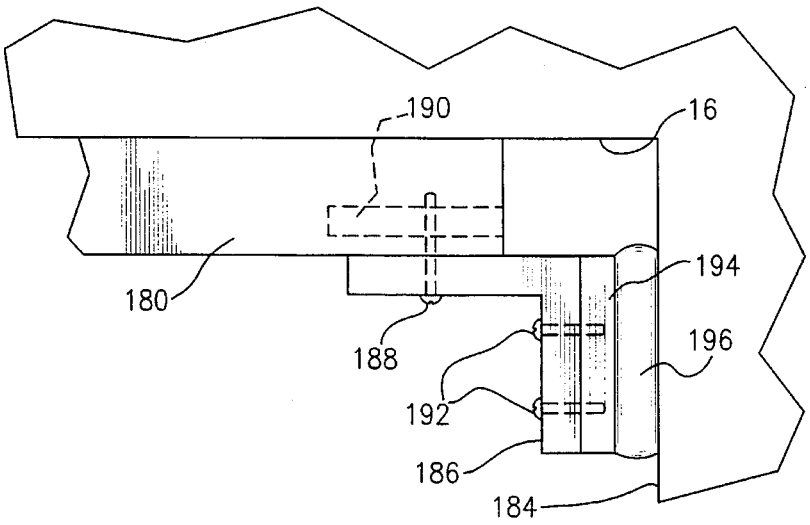
FIG. 7 is a plan view of a representative means for securing the track element of FIG. 6 above the bathtub.

An alternative support track element 180 is depicted in FIG. 6. That support track element again includes a central slot 88 having an enlarged recess 90. The slot is engaged by inside wheel bearings in the manner previously described. At the end of the track element 180 is formed a plurality of adjustment slots 181. These permit the track element 180 to be mounted to the wall above the bathtub in the manner shown in FIG. 7. Specifically, track element 180 extends along wall 16. The attachment means illustrated in FIG. 7 interengage track element 80 with one of the end walls 184 above the tub. It should be noted that an analogous attachment is formed at the opposite end of track element 180 for interengaging the track to the opposite end wall of the bathtub. One leg of an angle bracket 186 is secured to track element 180 by a screw or bolt 188 that extends through one of the adjustment slots 181 and engages a nut-like plate 190 received within hollow track element 180. Pressure screws 192 secure the other leg, of bracket 186 to a pressure plate 194 that is itself interengaged with a rubber gasket 196. The rubber gasket is secured to respective end wall 184 by an appropriate glue or adhesive.

The above form of attachment permits a standard length track element 180 to be fastened adjacent various lengths of bathtubs. If the end walls 184 are slightly closer together or farther apart, the adjustment angle bracket 186 is secured to track element 180 at a different position along adjustment slots 181.

The multiposition bathtub seat apparatus of this invention permits persons having various disabilities to operate and use a bathtub shower much more conveniently than has hereto been possible. The apparatus can be positioned, set and subsequently moved within the tub quickly and with minimal effort. The user does not have to get up off the seat to reposition the apparatus. Significantly, the user is less dependent upon a caretaker and is able to shower in a much more convenient, comfortable and dignified manner.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A multiple position bathtub seat apparatus for use in combination with a bathtub having a pair of generally parallel, longitudinal sides said apparatus comprising:

a support frame that extends generally between the longitudinal sides of the bathtub;

a seat portion carded by said support frame between the longitudinal sides;

means for movably mounting said support frame to the longitudinal sides of the tub, including rotatable bearing members that are carried by said support frame and an elongated track member supported above and extending along at least one of the longitudinal sides and being engaged by at least two of said rotatable bearing members for guiding said support frame and said seat to move selectively back and forth on the tub between multiple longitudinal positions said track members including an inside track element arranged along an inner longitudinal side of the tub and said rotatable bearing members including inside wheels that rotatably engage said inside track element, said inside track element further including a plurality of slots that define selected longitudinal positions along said bathtub;

a latching device connected to said support frame end being engageable with a selected one of said slots in said inside track element to lock said support frame in said selected position defined by said slot, said latching device including a pin adjustably attached to said support assembly, spring means that bias said pin toward said inside track element and into a selected one of said slots, and a handle secured to said pin for selectively removing said pin from said selected slot so that said support frame may be longitudinally repositioned along said bathtub; and stop means attached to at least one of said support frame, said seat portion and said pin for limiting the degree to which said pin may be moved away from said track element.

2. A multiple position bathtub seat apparatus for use in combination with a bathtub having a pair of generally parallel, longitudinal sides, the bathtub being bounded by a pair of vertical end walls respectively located at opposing ends of the tub and an inside wall extending along the inner longitudinal side of the tub and interconnecting the vertical end walls, said apparatus comprising:

a support frame that extends generally between the longitudinal sides of the bathtub;

a seat portion carried by said support frame between the longitudinal sides;

means for movably mounting said support frame to the inner longitudinal side of the tub, including rotatable bearing members that are carried by said support frame and an elongated track member supported above and extending along the inner longitudinal side and being engaged by at least two of said rotatable bearing members for guiding said support frame and said seat to move selectively back and forth along the tub between multiple longitudinal positions, said track member including an inside track element arranged along the inner longitudinal side of the tub and said rotatable bearing members including inside wheels that rotatably engage said inside track element, said inside track element including a longitudinal slot, said wheels interengaging said slot and having a diameter that is larger than the width of said slot to retain said wheels in said track element;

means for interengaging a first end of said track element to one of the vertical end walls and an opposite second end of the track element to the other vertical end wall; and means on said support frame to engage the outer longitudinal side of said tub.

3. The apparatus of claim 2 in which said rotatable bearing members further include outside wheels disposed above outer longitudinal side of said bathtub.

4. The device of claim 3 in which said outside wheels directly engage said outside longitudinal side.

5. The apparatus of claim 3 in which said means for mounting further include an outside track element arranged along said outside longitudinal side and said outside wheels rotatably engage said outside track element.

6. The apparatus of claim 3 in which said support frame includes a generally flat central section that carries said seat portion, a raised inner section that carries said inside wheel means and a raised outer section that carries said outside wheel means.

7. The apparatus of claim 3 further including means for adjusting the lateral position of said outside wheels.

8. The apparatus of claim 3 in which said support frame includes a central section that carries said seat portion, an inner section that carries said inside wheel means and an outer section that carries said outside wheel means, said outer section supporting a side seat portion that is separate and distinct from said seat portion and located above said outer longitudinal side of said bathtub.

9. The apparatus of claim 2 further including means for locking said support frame and seat portion in a selected one of said longitudinal positions.

10. The apparatus of claim 2 in which said inside track member includes a plurality of slots that define selected longitudinal positions along said bathtub and further including a latching device connected to said support frame and being engageable with a selected one of said slots in said inside track member to lock said support frame in said selected position defined by said slot.

11. The apparatus of claim 10 in which said latching device includes a pin adjustably attached to said support assembly, spring means that bias said pin toward said inside track member and into a selected one of said slots, and a handle secured to said pin for selectively removing said pin from said selected slot so that said support frame may be longitudinally repositioned along said bathtub.

12. The apparatus of claim 11 further including stop means attached to at least one of said support frame, said seat portion and said pin for limiting the degree to which said pin may be moved away from said track element.

13. The apparatus of claim 2 in which said seat portion includes a generally horizontal seat surface that is secured to said support frame and a generally vertical seat back that is connected to said horizontal seat surface.

14. The apparatus of claim 13 further including means for securing said seat portion to a selected one of a plurality of positions on said support frame.

15. The apparatus of claim 2 in which releasable seat belt means are secured to said seat portion.

16. The apparatus of claim 2 in which said means for interengaging include a first bracket interengaged between said first end of said inside track element and a first one of said end walls and a second bracket interengaged between said second end of said inside track member and a second said end wall, and further including means for securing at least one of said brackets at multiple selected locations along said track element such that said brackets are adjustable to accommodate various distances between said end walls.

17. A multiple position bathtub seat apparatus for use in combination with a bathtub having a pair of generally parallel longitudinal sides, said apparatus comprising:

a support frame that extends generally between the longitudinal sides of the bathtub;

a seat portion carried by said support frame between the longitudinal sides; and means for movably mounting said support frame to the longitudinal sides of the tub, including rotatable bearing members that are carried by said support frame and an elongated track member supported above and extending along at least one of the longitudinal sides and being engaged by at least two of said rotatable bearing members for guiding said support frame and said seat to move selectively back and forth on the tub between multiple longitudinal positions, said track members including an inside track element arranged along an inner longitudinal side of the tub and said rotatable bearing members including inside wheels that rotatably engage said inside track element, said rotatable bearing members further including outside wheels disposed above the outer longitudinal side of said bath tub, said support frame including a generally flat central section that carries said seat portion, a raised inner section that carries said inside wheels and a raised outer section that carries said outside wheels.

18. The apparatus of claim 17 in which said raised outside section supports a side seat portion above said outer longitudinal side region of said bathtub.

19. The apparatus of claim 18 in which said seat portion includes a horizontal seat surface that is generally coplanar with said side seat portion.

* * * * *